United States Patent [19]

Pace et al.

[11] 3,981,784

[45] Sept. 21, 1976

[54] ELECTROLYSIS PROCESS AND APPARATUS

[75] Inventors: Gerald F. Pace, Casa Grande, Ariz.; John C. Stauter, Arlington Heights, Ill.; Calvin N. Armstrong; Gary R. Harris, both of Ponca City, Okla.

[73] Assignee: Continental Oil Company, Ponca City, Okla.

[22] Filed: Oct. 29, 1974

[21] Appl. No.: 518,841

[52] U.S. Cl. ..... 204/105 R; 204/108; 204/272

[51] Int. Cl.[2] ..... C25C 1/12; C25C 7/00

[58] Field of Search ..... 204/DIG. 1, 273, 272, 204/105 R, 108

[56] References Cited

UNITED STATES PATENTS 2,710,832 6/1955 Harr ..... 204/48

OTHER PUBLICATIONS

Chem. Abstract, vol. 21, p. 1414, Metalwaren, Ind., Galvano-Tech:24, 408–409 (1926).

Trans. Electrochem Soc., vol. 80, 1941, p. 504.

Corrosion Prevention & Control, Nov./Dec. 1968, pp. 13–14.

Electroplating Engineering Handbook, 2nd Ed., A. K. Graham, 1962, pp. 530–531.

*Primary Examiner*—R. L. Andrews
*Attorney, Agent, or Firm*—Richard W. Collins

[57] ABSTRACT

An improved process and apparatus for electrolyzing ions in a liquid electrolyte wherein the electrolyte is covered by an immiscible liquid of low conductivity and whereby the entrainment of said immiscible liquid in said electrolyte is prevented.

9 Claims, 4 Drawing Figures

ELECTROLYSIS PROCESS AND APPARATUS

BACKGROUND OF THE INVENTION

1. Field of the Invention

The process and apparatus of this invention relate to the electrolytic recovery of copper or other materials, and more particularly, but not by way of limitation, to electrowinning high purity copper from an aqueous electrolyte.

2. Description of the Prior Art

Electrolysis of copper has been used as a technique for refining copper and for recovering copper from solvents used in copper extraction processes. For example, one process for recovering copper involves subjecting solid materials containing copper to acid or salt leaching followed by extraction purification and electrolytic recovery of the copper from the extraction solvent. Generally, heretofore, impurities such as iron, cobalt, molybdenum, and other compounds contained in the extraction solvent resulted in the recovery of relatively low purity copper in the electrolytic recovery process. The impurities and usual low copper concentration in the solvent have caused the electrolytic recovery process to be of low efficiency and poor recovery.

U.S. Pat. application Ser. No. 332,538 filed Feb. 14, 1973 and assigned to the assignee of this present invention discloses a greatly improved electrolysis process and apparatus for the electrolytic recovery of copper and other metals, which process and apparatus achieve the electrowinning of high purity copper at high efficiency and high current density from liquors or extraction solvents having low copper concentration and containing impurities and gaseous reagents. As described in detail in the application, the process is carried out in apparatus comprising an electrolysis tank containing anode and cathode electrodes immersed in electrolyte contained the electrodes being connected therein, to means for impressing an electric potential between the anode and cathode and through the electrolyte. Means for agitating the electrolyte and controlling the temperature of the electrolyte at a selected level are also provided. A particular novel aspect of the invention of the aforementioned application involves covering the electrolyte in the electrolysis tank with a layer of an immiscible fluid of low conductivity to prohibit gas evolution and misting from the electrolyte and electrolysis tank, as well as preventing oxygen and other impurities from entering the electrolyte from the atmosphere. The process includes circulating the electrolyte through the electrolysis apparatus with the electrolyte continuously being covered by the layer of immiscible non-conductive fluid. In recovering copper from an aqueous acid electrolyte in accordance with the invention, the concentration of sulfur dioxide in the electrolyte is adjusted and controlled by injecting sulfur dioxide thereinto as the electrolyte is circulated. The temperature of the electrolyte is controlled at a selected level and the electric potential impressed between the electrodes brings about the formation of sulfuric acid at the anode and the deposition of high purity copper at the cathode. The cover of low conductivity immiscible fluid on top of the electrolyte prevents sulfur dioxide and other vapors from evolving from the electrolysis tank during the carrying out of the process as well as misting of the electrolyte from the apparatus, etc.

While the above-described process and apparatus have achieved a high degree of success in the recovery of high purity copper and other metals from electrolytes at high efficiency and high current density, problems have been encountered in that the necessary agitation or circulation of the electrolyte causes agitation of the interface between the electrolyte and the covering immiscible liquid resulting in droplets of the immiscible liquid being drawn into the electrolyte. That is, the formation of vortices due to pressure changes and agitation due to fluid movement causes droplets of the immiscible liquid to be drawn into the electrolyte which are emulsified as they are circulated through the system. The build-up of electrolyte-immiscible liquid emulsion in the electrolysis system in turn interferes with the deposition of the metal sought to be recovered and reduces the efficiency of the process.

By the present invention an improved process and apparatus are provided wherein problems relating to the entrainment and emulsification of immiscible covering liquid with the electrolyte are obviated.

SUMMARY OF THE INVENTION

The improved apparatus of the present invention basically comprises an electrolysis tank for containing a liquid electrolyte and an immiscible liquid of low conductivity, the immiscible liquid covering the electrolyte, at least one positively charged electrode disposed in the tank and in the electrolyte, at least one negatively charged electrode disposed in the tank and the electrolyte, means attached to the electrodes for impressing an electrical potential between the electrodes and through the electrolyte, means for agitating the electrolyte attached to the tank, and at least one buoyant member disposed in the tank, said buoyant member being formed of low conductivity material and having a density such that the member floats near the interface between the electrolyte and the immiscible covering liquid thereby reducing the area of said interface to a relatively small area and preventing entrainment of the immiscible liquid in the electrolyte. The invention also provides an improved electrolytic recovery process which is carried out in the apparatus of the invention.

It is, therefore, a general object of the present invention to provide an improved electrolysis process and apparatus.

A further object of the present invention is the provision of an improved electrolysis process and apparatus for carrying out the process which prevent or substantially reduce the entrainment and agitation of immiscible covering liquid in the electrolyte used.

Other and further objects, features and advantages of the invention will be readily apparent to those skilled in the art upon a reading of the description of preferred embodiments of the invention which follows when taken with the accompanying drawings.

DESCRIPTION OF PREFERRED EMBODIMENTS

The process of the invention described and claimed in U.S. Pat. application Ser. No. 332,538 filed Feb. 14, 1973 mentioned above is particularly suitable for the electrowinning of copper from aqueous pregnant liquor electrolyte, i.e., electrolyte containing copper ions and many other ions such as iron, aluminum, and oxygen which normally reduce efficiency in electrolysis product purity. In accordance with the invention, a layer or cover of immiscible liquid is placed in the electrolysis tank on top of the electrolyte thereby preventing undesirable gas evolution and electrolyte misting, as well as absorption of impurities from the atmosphere by the electrolyte. Immiscible liquids which are suitable for use as covers for the electrolyte are those liquids which are immiscible with the electrolyte and which are of low conductivity. Preferred immiscible liquids for covering aqueous electrolytes are hydrocarbon oils, substituted hydrocarbon oils, or hydrocarbon-based oils. As stated above, these covering liquids form emulsions with the aqueous electrolyte if drawn thereinto due to agitation of the electrolyte which in turn interfere with the efficient operation of the electrolysis apparatus. The process of the present invention, like the process of U.S. application Ser. No. 332,538, includes covering the electrolyte with a layer of immiscible liquid, but in addition, provides for the substantial elimination of problems associated with the formation of covering liquid-electrolyte emulsions.

Figure 1:
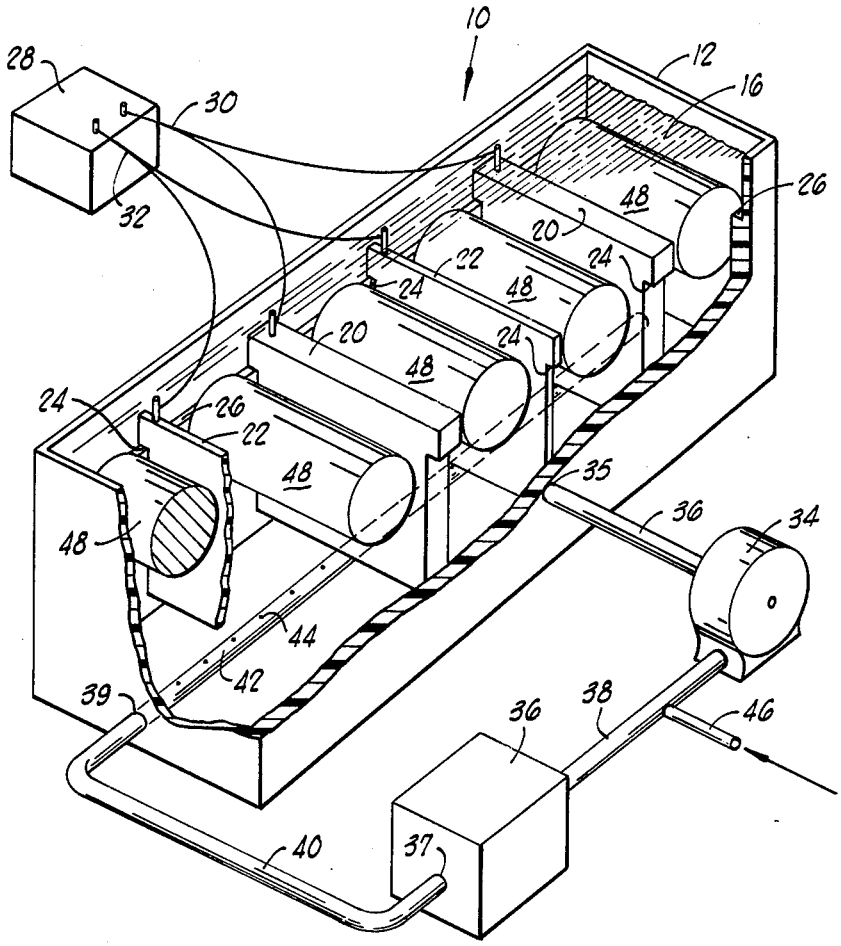
FIG. 1 is a perspective view of the electrolysis apparatus of the present invention.
Figure 2:
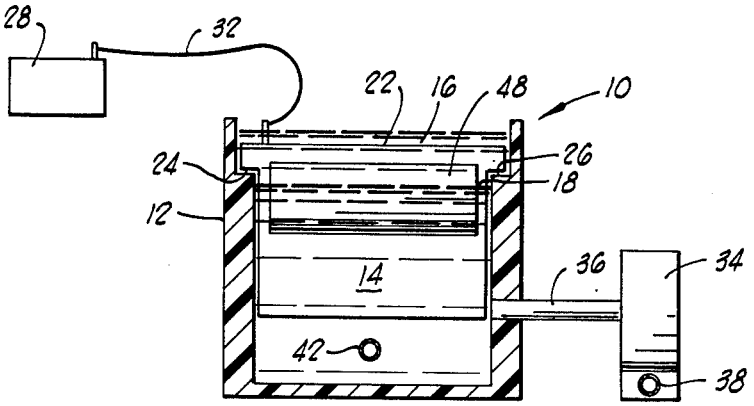
FIG. 2 is an end view of the apparatus of FIG. 1 taken in cross section.
Figure 3:
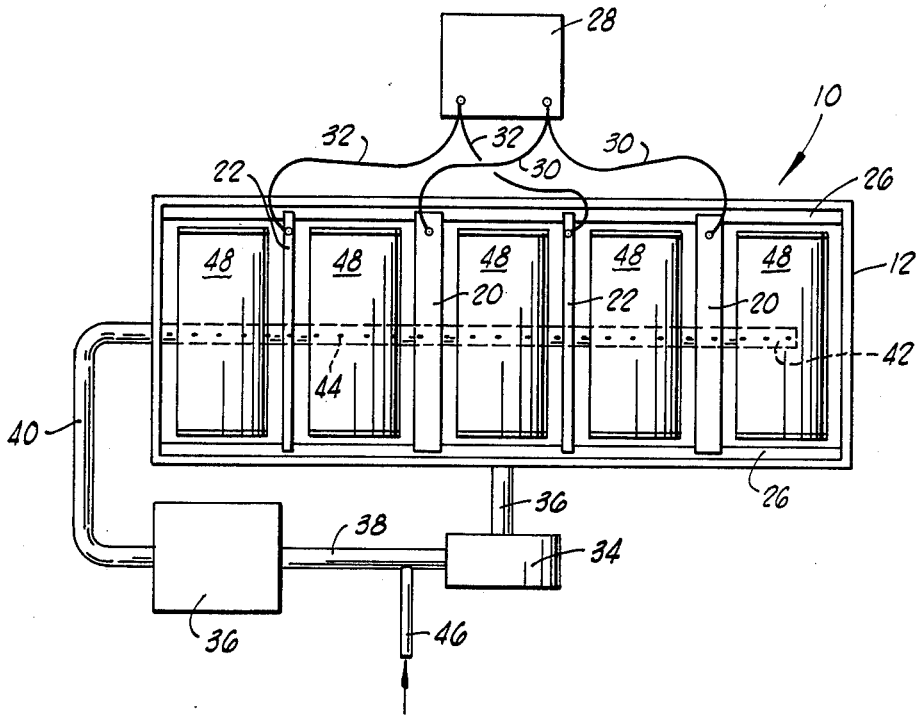
FIG. 3 is a top plan view of the apparatus of FIG. 1.

Referring now to the drawings and particularly to FIGS. 1 through 3, the apparatus of the present invention is illustrated and generally designated by the numeral 10. The apparatus 10 includes an elongated electrolysis tank 12 for containing electrolyte and immiscible liquid of low conductivity. As shown best in FIG. 2, the electrolysis tank 12 contains a body of the electrolyte 14 covered by a layer of immiscible liquid of low conductivity 16. A horizontal interface 18 is formed in the tank 12 between the immiscible liquid 16 and the electrolyte 14.

A pair of positively charged electrodes (anodes) 20 and a pair of negatively charged electrodes (cathodes) 22 are removably disposed in spaced relationship within the tank 12. In a presently preferred embodiment of the invention, the electrodes 20 and 22 are formed of generally rectangular shape and positioned vertically within the tank 12 so that major portions of the electrodes extend downwardly and are immersed in the body of electrolyte 14 contained within the tank 12. Further, the electrodes 20 and 22 are positioned transversely to the longitudinal axis of the tank 12 and each includes a pair of downwardly facing shoulders 24 at opposite ends near the top for engaging continuous upwardly facing shoulders 26 provided on opposite sides of the tank 12. As will be understood by those skilled in the art, the electrodes 20 and 22 are disposed within the tank 12 in alternating spaced relationship, i.e., the anode and cathode electrodes are alternated so that each electrode is positioned adjacent an electrode of opposite charge. As will be further understood, the tank 12 can include more or less electrodes than those described herein and shown in the drawings, but at least one negatively charged electrode and at least one positively charged electrode are required for carrying out the electrolysis process. The electrodes 20 and 22 are connected to a direct electric current supply means 28 by suitable electric wires 30 and 32 so that an electrical potential is impressed between the electrodes and through the body of electrolyte 14. More specifically, the wires 30 are connected to the anodes 20 and to the positive side of the electric current supply means 28 and the wires 32 are connected to the cathodes 22 and to the negative side of the electric current supply means 28.

An electrolyte pump 34 is provided, the suction or inlet connection of which is connected to an outlet connection 35 in a side of the electrolysis tank 12 by a conduit 36. The discharge or outlet connection of the pump 34 is connected to the inlet connection (not shown) of a conventional thermostatically controlled heater 36. The outlet connection 37 of the heater 36 is connected by a conduit 40 to an inlet connection 39 in an end of the electrolysis tank 12, and a distribution pipe 42 is disposed within the tank 12 sealingly attached to the inlet connection 39 so that electrolyte flowing through the conduit 40 is caused to flow into the distribution pipe 42. The distribution pipe 42 is disposed longitudinally in the bottom portion of the tank 12 and includes a plurality of spaced perforations positioned at the top and along the length thereof.

A conduit 46 is connected to the conduit 38 for injecting additives and chemicals into the electrolyte passing through the conduit 38, e.g., sulfur dioxide.

Referring still to FIGS. 1 through 3, a plurality of buoyant members 48 are disposed within the electrolysis tank 12 between the electrodes 20 and 22 as well as between the electrodes and the ends of the tank 12. The buoyant members 48 are preferably formed of a non-reactive, non-conductive material, e.g., polyvinyl chloride, and have a density such that they float near the interface 18 (FIG. 2) between the body of electrolyte 14 and layer of immiscible liquid 16 whereby portions of the buoyant members 48 extend into both the immiscible liquid and the electrolyte thereby reducing the horizontal area of the interface 18 to a relatively small area. That is, the densities of the buoyant members 48 are preferably adjusted so that the axes thereof lie at or near the horizontal plane formed by the interface 18. Further, the length and width of the buoyant members 48 are such that the members 48 substantially fill the voids in the tank 12 between the electrodes 20 and 22 and between the ends of the tank 12 and the electrodes 20 and 22 thereby reducing the area of the interface 18 to the relatively small areas between the sides of the electrolysis tank 12, the electrodes 20 and 22 and the members 48.

Figure 4:
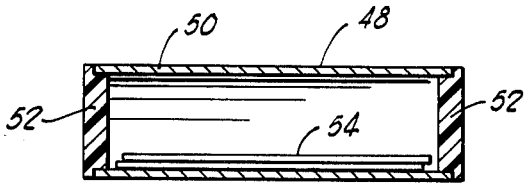
FIG. 4 is an elevational view of a buoyant member of the present invention taken in cross section.

Referring now to FIG. 4, one of the buoyant members 48 is illustrated in cross section. Preferably, the buoyant member 48 is comprised of a hollow cylindrical elongated body member 50 closed at opposite ends by closure members 52. The closure members 52 may take a variety of forms such as stoppers or caps and are sealingly connected to the cylindrical body member 50. Preferably, at least one of the closure members 52 is removable, such as by the use of conventional threads. One or more weights 54 are disposed within the hollow interior of the member 48 for adjusting the density thereof whereby the member 48 will float at or near the interface 18 in the tank 12. The weights 54 can take any convenient shape such as elongated bars or rods.

The process of this invention for electrolyzing ions in a liquid electrolyte basically comprises the steps of impressing an electrical potential through said liquid electrolyte by way of electrodes immersed therein, agitating said electrolyte, continuously covering said electrolyte with a layer of low conductivity liquid which is immiscible with said electrolyte and reducing the area of the interface between said immiscible covering liquid and said electrolyte to a relatively small area so that agitation of said interface and entrainment of said immiscible liquid in said electrolyte is substantially prevented. In the apparatus of the invention described above which is preferred, the area of the interface between the immiscible liquid and the electrolyte is reduced by floating at least one of the buoyant members 48 at a level near the interface so that the interface is reduced to a small area between the outside surfaces of the buoyant member and the sides of the electrolysis tank within which the electrolyte and covering liquid are contained.

Operation

In carrying out the process of the invention in the apparatus 10 for the recovery of high purity copper from an aqueous acid electrolyte, i.e., an aqueous sulfuric acid electrolyte containing copper and other components encountered in acid leaching sulfite copper ores, the electrolyte is placed in the electrolysis tank 12 forming the body 14 thereof. A layer of covering liquid 16, e.g., kerosene, is placed on top of the body of electrolyte 14. The densities of the buoyant members 48 are each adjusted by adding or removing weights 54 from the hollow interiors thereof so that they are buoyed up by the electrolyte and float at the interface 18.

The electrical supply means 28 is activated so that an electrical potential is impressed between the electrodes 20 and 22 and through the electrolyte contained in the tank 12, and the pump 34 is started so that electrolyte is circulated from the tank 12, by way of the conduit 36, the pump 34, the conduit 38, the heater 34 and the conduit 40 into the distribution pipe 42 disposed within the tank 12. As will be understood, the distribution pipe 42 distributes the circulated electrolyte into the tank 12 along the entire length thereof so that the electrolyte flows evenly through the tank 12 between the electrodes 20 and 22.

The conventional thermostatically controlled heater 36 is activated and set so that the body of electrolyte 14 within the tank 12 is maintained at a predetermined selected temperature. Further, sulfur dioxide is injected into the electrolyte circulating through the conduit 38 by way of the conduit 46 attached thereto at a rate such that the sulfur dioxide concentration in the electrolyte is maintained at a desired level.

The pump 34 is continuously operated during operation of the apparatus 10 causing the body of electrolyte 14 within the tank 12 to be continuously agitated which in turn prevents the polarization of components in the electrolyte which are subjected to the electric potential between the electrodes immersed therein. The continuous circulation of the electrolyte through the external circuit provided by the conduits 26, 28 and 40, the pump 34 and the heater 36 facilitates accurate control of the temperature of the electrolyte within the tank 12 and the accurate maintenance of the desired sulfur dioxide concentration in the electrolyte. However, as will be readily apparent to those skilled in the art, numerous other means of agitating and heating the electrolyte as well as maintaining the concentration of additives in the electrolyte can be substituted for the external apparatus disclosed.

Because the buoyant members 48 float in the electrolyte at the interface 18 between the electrolyte and the immiscible covering liquid and substantially fill the voids in the tank 12 between the ends and sides thereof and the electrodes 20 and 22, the formation of vortices and agitation at the interface 18 due to the movement and circulation of the electrolyte is substantially prevented. This in turn prevents the entrainment of portions of the immiscible liquid in the electrolyte and the formation of immiscible liquid-electrolyte emulsion.

As stated above, the process of the invention and the apparatus 10 are not limited to electrolysis applications wherein high purity copper is recovered from aqueous acid electrolyte, but find utility in any application where it is desirable to electrolyze ions in a liquid electrolyte while preventing evolution of gases, misting from the electrolysis tank 12, and protect the electrolyte from the atmosphere by covering the electrolyte with an immiscible liquid.

Thus, the process and apparatus of the present invention are well suited to carry out the objects and attain the ends and advantages mentioned as well as those inherent therein. While presently preferred embodiments of the invention are given for the purpose of disclosure, numerous changes in the details of construction and arrangement of parts can be made which will readily suggest themselves to those skilled in the art. For example, the buoyant members 48 can take a variety of shapes, can be hollow or solid, and can be formed from a variety of substantially non-conductive materials or can be an integral part of the electrolysis tank 12. Such changes will readily suggest themselves to those skilled in the art and are encompassed within the spirit of this invention and the scope of the appended claims.

What is claimed is:

1. An improved apparatus for electrowinning ions from a liquid electrolyte which comprises:

a tank adapted to contain an electrolyte and an immiscible covering liquid of low conductivity;

at least one anode disposed in said tank and adapted to be immersed in said electrolyte; at least one cathode disposed in said tank and adapted to be immersed in said electrolyte;

means attached to said tank for agitating said electrolyte within said tank;

means for impressing an electrical potential between said anode and cathode and through said electrolyte;

means for maintaining the temperature of said electrolyte at a selective level attached to said tank; and at least one body member disposed in said tank, said member being formed of low conductivity material and having a density such that said member is adapted to float near the interface between said electrolyte and said immiscible liquid whereby the area of said interface is reduced and entrainment of said immiscible liquid in said electrolyte is prevented.

2. The apparatus of claim 1 wherein said means for agitating said electrolyte comprises:

said tank including electrolyte inlet and outlet connections;

an electrolyte circulation pump; and conduit means connecting said electrolyte circulation pump to said inlet and outlet connections of said tank so that said electrolyte is circulated by said pump through said tank.

3. The apparatus of claim 2 wherein said body member is formed of polyvinyl chloride.

4. The apparatus of claim 3 wherein said body member is an elongated hollow cylinder closed at both ends.

5. The apparatus of claim 4 wherein said elongated cylindrical body member is further characterized to include one or more removable weights disposed therein whereby the density of said member can be selectively adjusted.

6. A process for electrowinning ions from a liquid electrolyte comprising the steps of:

impressing an electrical potential through said electrolyte by way of electrodes immersed therein;

agitating said electrolyte;

continuously covering said electrolyte with a layer of low conductivity liquid which is immiscible with said electrolyte; and reducing the area of the interface between said immiscible liquid and said electrolyte to a relatively small area by floating at said interface at least one body member having a density such that said body member floats at the interface between said immiscible liquid and said electrolyte so that agitation of said interface and entrainment of said immiscible liquid in said electrolyte is substantially prevented.

7. The process of claim 6 wherein said liquid electrolyte is an aqueous sulfuric acid leach solution containing copper ions.

8. The process of claim 6 wherein said electrolyte is an aqueous solution and said immiscible covering liquid is a hydrocarbon liquid.

9. The process of claim 6 wherein said electrolyte is an aqueous sulfuric acid solution.

* * * * *